US005113043A

United States Patent [19]

Morris

[11] Patent Number: 5,113,043

[45] Date of Patent: May 12, 1992

[54] CIRCUIT BREAKER SAFETY INTERLOCK UNIT

[75] Inventor: Robert A. Morris, Burlington, Conn.

[73] Assignee: General Electric Company, New York, N.Y.

[21] Appl. No.: 660,754

[22] Filed: Feb. 25, 1991

[51] Int. Cl.[5] ..... H01H 7/08

[52] U.S. Cl. ..... 200/43.01; 200/43.14

[58] Field of Search ..... 200/43.01, 43.14, 43.15

[56] References Cited

U.S. PATENT DOCUMENTS

| | | | |
|---|---|---|---|
| 3,649,784 | 3/1972 | Middendorf et al. | 200/43.14 |
| 3,678,228 | 7/1972 | Adamson | 200/43.15 |
| 4,733,029 | 3/1988 | Kobayashi et al. | 200/43.15 |
| 4,754,247 | 6/1988 | Raymont et al. . | |
| 4,864,263 | 9/1989 | Castonguay et al. . | |
| 4,912,439 | 3/1990 | Nagy et al. . | |
| 4,978,816 | 12/1990 | Castonguay et al. . | |
| 4,982,173 | 1/1991 | Meiners et al. . | |

*Primary Examiner*—Leo P. Picard
*Assistant Examiner*—Lincoln Donovan
*Attorney, Agent, or Firm*—Richard A. Menelly; Fred Jacob

[57] ABSTRACT

The position of the contacts within industrial-rated circuit breakers is externally ascertained by means of an auxiliary switch-contact position verifier accessory. A viewing aperture in the circuit breaker accessory cover provides visual access to a color-coded shutter that forms part of the auxiliary switch accessory and operates off the circuit breaker crossbar assembly. A safety interlock unit attached to the exterior surface of the circuit breaker cover interacts with the shutter to prevent the circuit breaker from being turned on. The interlock unit also interacts with the circuit breaker trip-test button to articulate the circuit breaker operating mechanism.

11 Claims, 5 Drawing Sheets

CIRCUIT BREAKER SAFETY INTERLOCK UNIT

BACKGROUND OF THE INVENTION

U.S. Pat. No. 4,978,816 entitled "Circuit Breaker Handle Interlock Arrangement" describes an interlock feature that prevents the circuit breaker handle from being padlocked when the circuit breaker handle is in its ON position.

U.S. Patent application Ser. No. (41PR-6786) entitled "Circuit Breaker Contacts Condition Indicator" describes a combined auxiliary switch and contacts indicator accessory that allows visual verification of the OPEN and CLOSED conditions of the circuit breaker contacts.

U.S. Pat. No. 4,982,173 entitled "Rotatable Trip Test Assembly for Molded Case Circuit Breakers" describes an externally-accessible trip-test button that is pressed to articulate the circuit breaker operating mechanism for test purposes.

All of the aforementioned U.S. Patents and Patent application are incorporated herein and should be reviewed to determine the advanced state of the art of circuit breaker technology.

When such circuit breakers are used within an industrial power delivery system to protect electrical equipment some means must be employed to insure that the circuit breakers are not inadvertently turned on when work is being undertaken on the associated equipment. Further means are required to insure that the circuit breaker contacts are in their OFF condition when the circuit breaker is padlocked to prevent access to the circuit breaker operating handle.

Accordingly, the present invention proposes a safety interlock that operates to automatically articulate the circuit breaker operating mechanism to insure that the contacts are in their OPEN condition while simultaneously preventing the circuit breaker from being interlocked when the circuit breaker contacts are in their CLOSED condition.

SUMMARY OF THE INVENTION

A combined auxiliary switch-contact indication accessory is installed within the cover of an industrial rated circuit breaker to provide visual indication of the OPEN and CLOSED conditions of the circuit breaker contacts by means of a visual access window formed in the circuit breaker cover along with remote indication by means of the auxiliary switch unit. The provision of a safety interlock unit in the form of an externally mounted padlock support allows the circuit breaker to be interlocked when the contacts are in their OPEN condition. The padlock support interacts with the auxiliary switch-contacts indicator unit and the circuit breaker trip-test button to insure that the contacts are in their OPEN condition before the circuit breaker is interlocked.

DESCRIPTION OF THE PREFERRED EMBODIMENT

Figure 1:
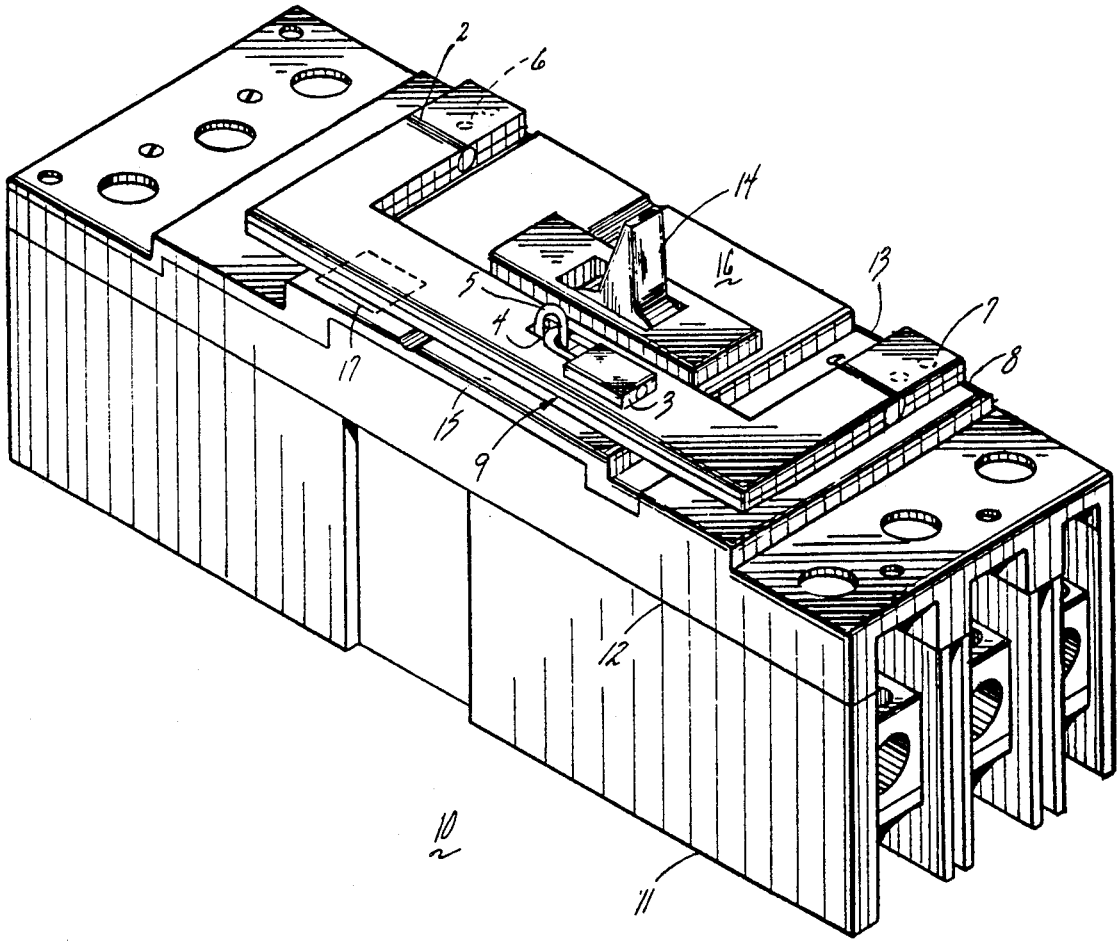
FIG. 1 is a top perspective view of a molded case circuit breaker employing the safety interlock unit in accordance with the invention.

An industrial-rated circuit breaker 10 is shown in FIG. 1 and basically consists of a molded plastic case 11 to which a molded plastic circuit breaker cover 12 and a molded plastic accessory cover 13 are fixedly attached. An operating handle 14 extends through the circuit breaker cover for turning the circuit breaker contacts between their OPEN and CLOSED conditions. Circuit breaker accessories such as shunt-trip, undervoltage, auxiliary switch and bell alarm units are positioned within the circuit breaker cover and are accessible through the accessory doors 15, 16. A rating plug 17 is used to set the current rating of the circuit breaker, such as described in U.S. Pat. No. 4,754,247.

In accordance with the invention a hinged safety interlock unit 9 is attached to the circuit breaker cover by means of machine screws 6. The interlock unit consists of a pair of top and bottom U-shaped metal plates 7, 8. The bottom plate supports an upstanding locking hasp 5 that passes through a slot 4 formed in the top plate. The top plate is hinged, as indicated at 2, to allow the top plate to be rotated away from the bottom plate, when not in use. A padlock 3 prevents rotating the top plate away from the bottom plate and thereby locks the circuit breaker into its interlocked condition. In such interlocked condition, the circuit breaker operating handle 14 is unable to move the circuit breaker contacts from their CLOSED to OPEN conditions for the reasons to be given below in greater detail.

Figure 2:
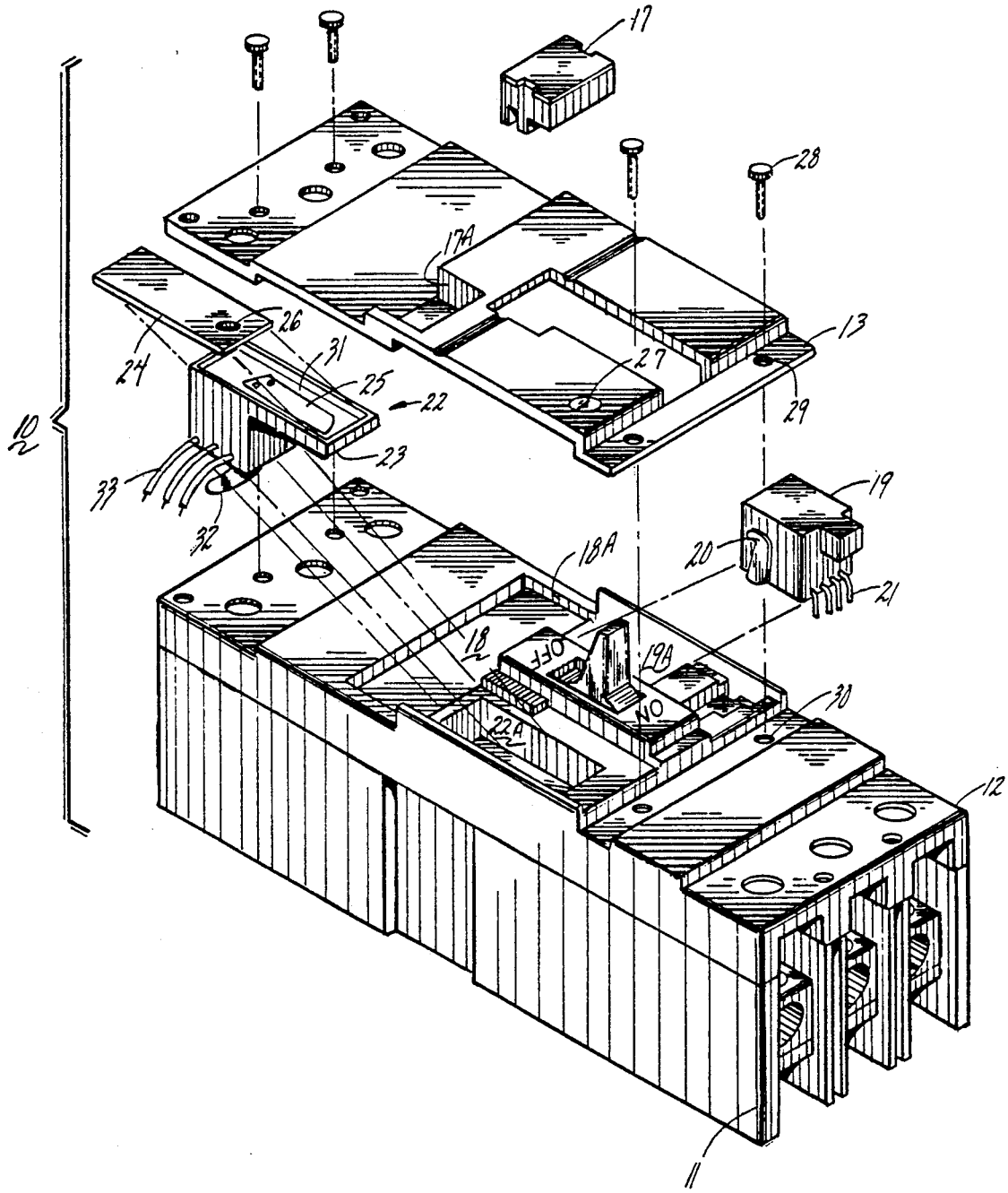
FIG. 2 is a top perspective view of the circuit breaker of FIG. 1 prior to assembly.

The circuit breaker is assembled in the manner best seen by referring now to FIG. 2 where the circuit breaker 10 is shown prior to positioning the rating plug 17 within the rating plug recess 17A formed in the accessory cover 13 and with the circuit breaker cover 12 already attached to the circuit breaker case 11. An actuator-accessory unit 19 is positioned within the actuator-accessory recess 19A formed in the cover and includes a latch 20 that interacts with the circuit breaker operating mechanism (not shown) in the manner described in U.S. Pat. No. 4,864,263. A plurality of wire conductors 21 allow the actuator-accessory unit to be operated from a remote location. An electronic trip unit 18 is positioned within a trip unit recess 18A also formed within the circuit breaker cover. As described in aforementioned U.S. Patent application (41PR-6786) a combined auxiliary switch-contact condition indicator unit 22 hereafter "switch-indicator unit" is positioned within the associated recess 22A in the circuit breaker cover and interacts with the circuit breaker crossbar contained within the circuit breaker case 11 by means of the depending lever 32 in the manner described within U.S. Pat. No. 4,912,439. Remote indication of the condition of the circuit breaker contacts is made by means of the wire conductors 33 extending from the bottom of the switch indicator case 23. A shutter 25 is pivotally positioned on the underlying surface 31 of the switch indicator unit before attaching the associated cover 24. An access hole 26 is arranged through the cover 24 in alignment with the aperture 27 in the accessory cover 13 for determining the position of the shutter 25 and the underlying surface 31. When the actuator-accessory unit 19 and switch indicator unit 22 are positioned within their associated recesses, the accessory cover 13 is fastened to the circuit breaker cover 12 by means of screws 28, thru-holes 29 and threaded openings 30.

Figure 3:
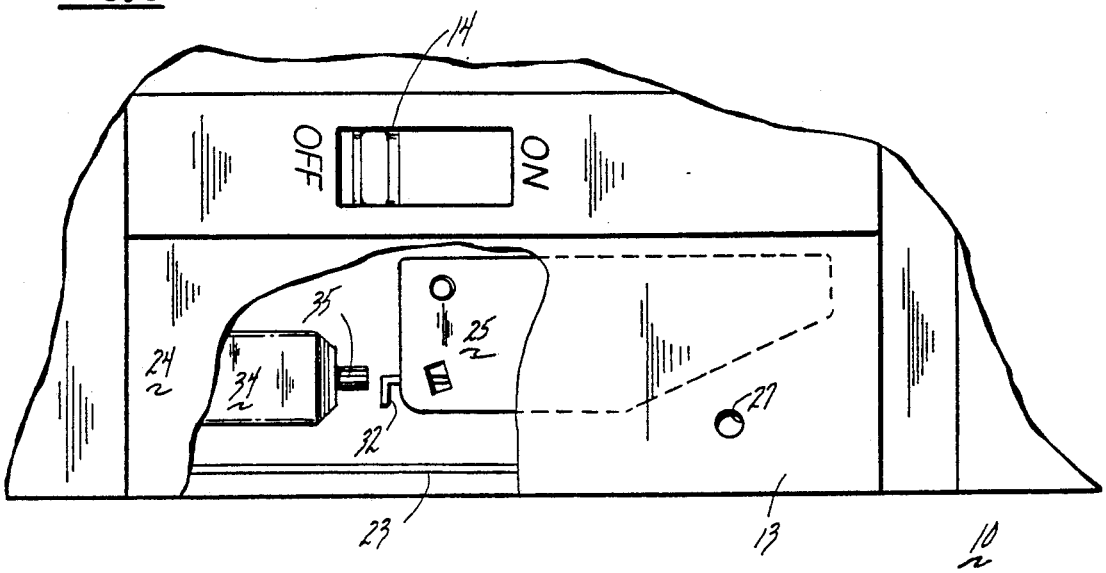
FIG. 3 is a top view in partial section of the circuit breaker of FIG. 1 with the circuit breaker contacts in the OFF condition.
Figure 4:
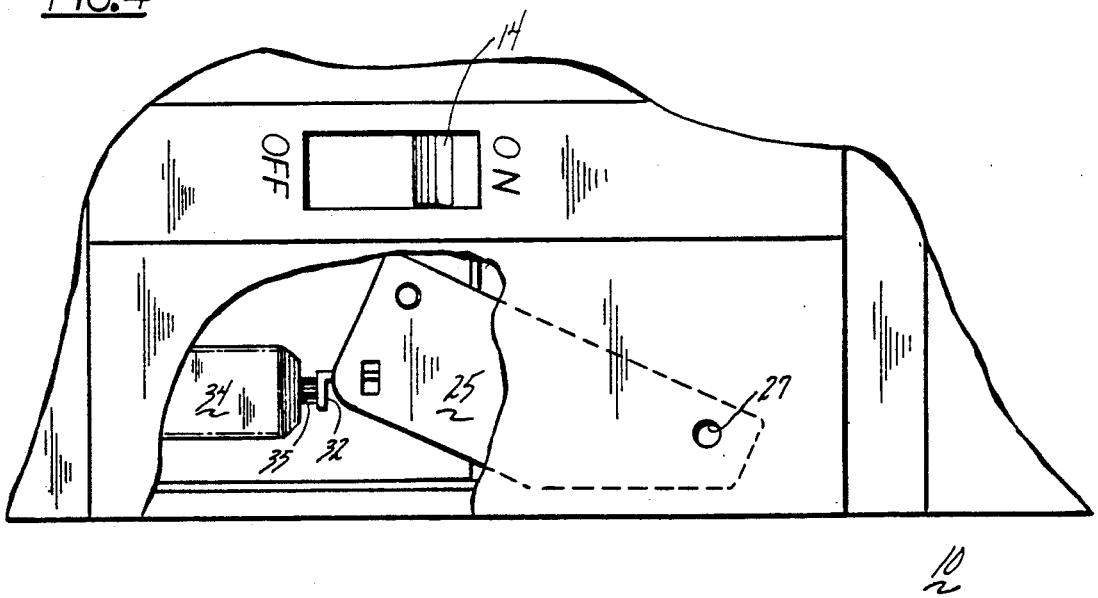
FIG. 4 is a top view in partial section of the circuit breaker of FIG. 1 with the circuit breaker contacts in the ON condition.

Referring now to the top of the circuit breaker 10 shown in FIGS. 3 and 4, it can be seen that the shutter 25 is away from the aperture 27 in the accessory cover 13 and the access hole 26 (FIG. 2) through the cover 24 of the switch-indicator case 23 when the operating handle 14 is in the OFF position and when the contacts are in their OPEN condition. As described in the aforementioned U.S. Patent application (41PR-6786) the position of the auxiliary switch lever 32 away from the switch button 35 on the microswitch 34 insures that the contacts are in their OPEN condition. With the circuit breaker operating handle 14 in the ON position shown on the circuit breaker 10 of FIG. 4, the shutter 25 is under the access hole 26 (FIG. 2) and the aperture 27 and the auxiliary switch lever 32 is against the switch button 35 on the microswitch 34 to insure that the contacts are in their CLOSED condition.

Figure 5:
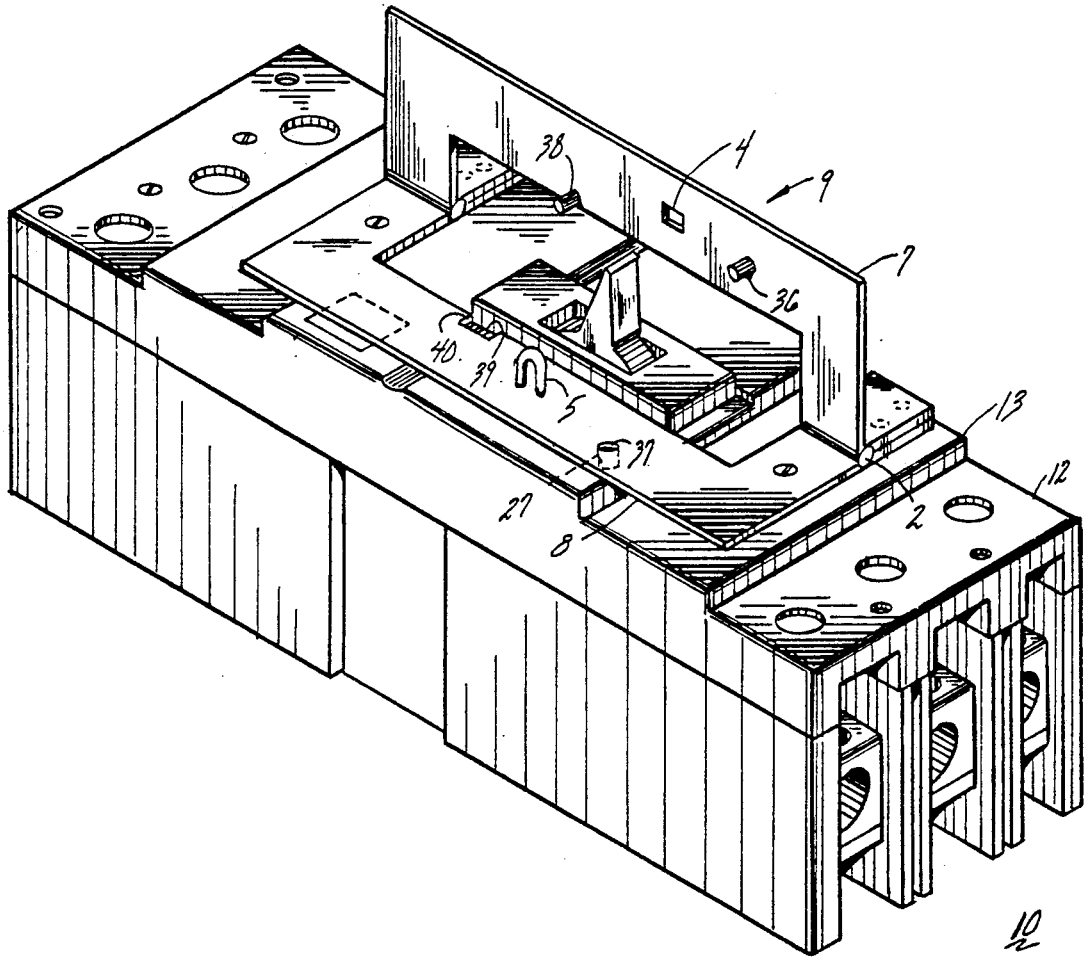
FIG. 5 is a top perspective view of the circuit breaker of FIG. 1 with the safety interlock unit in an inactive position.

The circuit breaker 10 is depicted in FIG. 5 with the safety interlock unit 9 in its inoperative position with the top plate 7 rotated away from the bottom 8 by means of the spring-loaded hinge 2. The top plate 7 is depicted in a vertical position relative to the circuit breaker cover 12 to more clearly show the interlock pin 36 and the trip pin 38. However, to prevent the circuit breaker from being padlocked by means of the exposed hasp 5 without the top plate 7 in abutment with the bottom plate 8, the spring-loaded hinge 2 biases the top plate 7 away from the bottom plate 8 such that the top plate must be forced into abutment with the bottom plate against the spring-loaded hinge bias. However, the actual rotation of the top plate a short distance away from the bottom plate by means of the spring-loaded hinge bias is not sufficient to allow access to the hasp 5. The bottom plate is positioned such that the upstanding hasp 5 aligns with the slot 4 in the top plate and the slot 40 in the bottom plate accommodates the trip-button 39. An interlock aperture 37 is positioned over the aperture 27 formed within the accessory cover 13 and is positioned under the interlock pin 36 extending from the bottom of the top plate 7. When the top plate 7 is rotated against the bottom plate 8, as depicted in FIG. 1, the trip pin 38 strikes the trip test button 39 to articulate the circuit breaker operating mechanism and separate the circuit breaker contacts. At the same time, the slot 4 encompasses the upstanding hasp 5 and the interlock pin 36 passes within the interlock aperture 37 and the aperture 27. This insures that the circuit breaker contacts are open and allows the circuit breaker to be padlocked in the OPEN condition.

Figure 6:
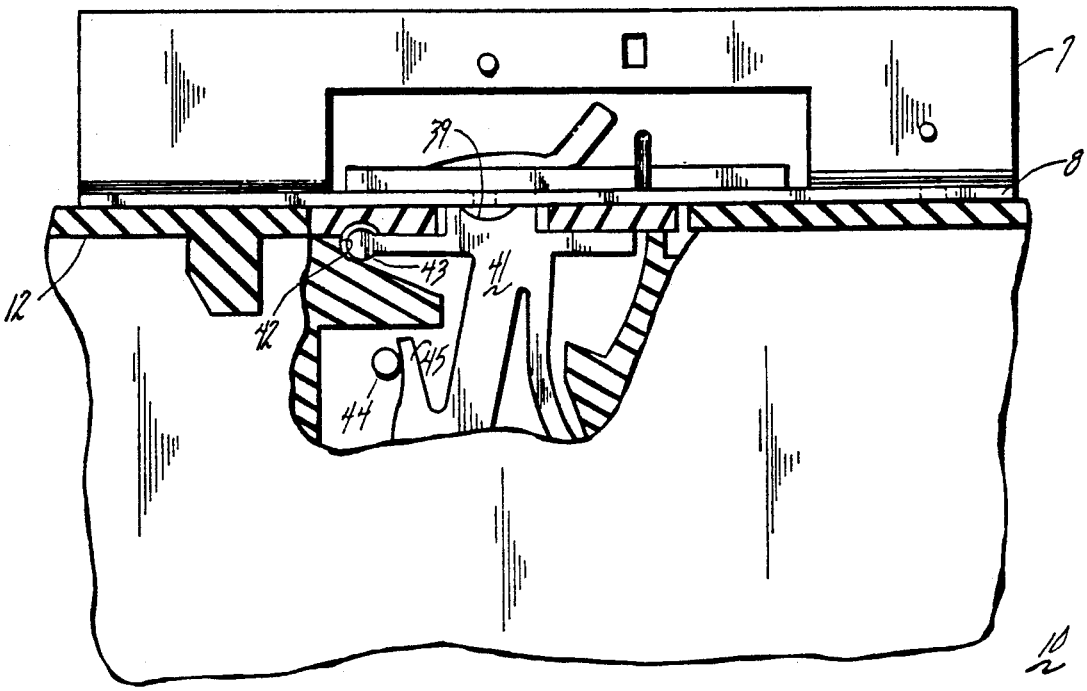
FIG. 6 is a side view in partial section of the circuit breaker of FIG. 1 depicting the test-trip button in an inactive position.

The circuit breaker 10 is depicted in FIG. 6 with the top plate 7 away from the bottom plate 8 and with part of the cover 12 removed to depict the trip test lever 41 which is similar to that described within U.S. Pat. No. 4,982,173. The trip lever is pivotally arranged within the circuit breaker cover by means of the spherical end 43 contained within the recess 42 as indicated. When the trip test button 39 is in its inactuated position shown in FIG. 6, the trip arm 45 on the trip test lever lightly abuts against the circuit breaker trip bar 44.

Figure 7:
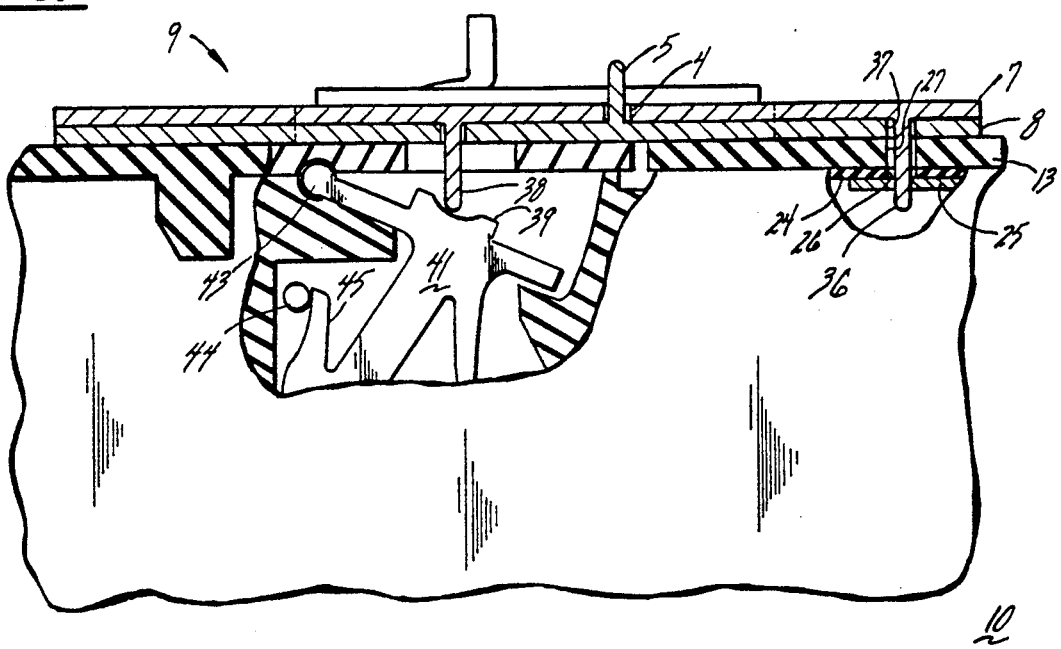
FIG. 7 is a side view in partial section of the circuit breaker of FIG. 1 depicting the test-trip button and safety interlock unit in an active position.

When the top plate 7 is rotated into contact with the bottom plate 8 to position the safety interlock unit 9 on the circuit breaker 10 shown in FIG. 7, the trip pin 38 strikes the trip test button 39 rotating the trip test lever 41 clockwise about the spherical end 43 driving the trip arm 45 against the trip bar 44 to articulate the circuit breaker operating mechanism. The shutter 25 assumes the position indicated earlier in FIG. 3 away from the aperture 27 in the accessory cover 13 and the access hole 26 in the switch-indicator unit cover 24. The interlock pin 36 passes through the aperture 27 and access hole 26 located directly under the interlock aperture 37 formed within the bottom plate 8. The upstanding hasp 5, at the same time, passes upwards through the slot 4 formed in the top plate to allow for the insertion of the padlock 3 (FIG. 1) through the locking hasp aperture. In the event that the contacts were welded in their CLOSED position and did not respond to the trip test button, the shutter 25 would have remained under the aperture 27, shown in FIG. 4 and thereby prevent the interlock pin 36 from passing through the access slot 26 and not allow the top plate 7 to contact the bottom plate 8 and thereby prevent the locking hasp 5 from passing through the slot 4 in the upper plate 7 to allow the circuit breaker to be interlocked.

Having thus described my invention, what I claim as new and desire to secure by Letters Patent is:

1. A circuit breaker safety interlock comprising;
a circuit breaker case and cover;
a pair of separable contacts within said case;
an operating mechanism within said case arranged for turning said contacts between OPEN and CLOSED conditions upon occurrence of an overcurrent condition within a protected circuit;
a trip-test button on said circuit breaker cover quiescent current conditions through said protected circuit;
a movable paddle within said circuit breaker cover arranged for automatic movement between a first position when said circuit breaker contacts are OPEN and a second position when said contacts are CLOSED; and
locking means on said circuit breaker cover interacting with said paddle whereby said locking means accepts a lock when said paddle is in said first position and said locking means rejects said lock when said paddle is in said second position.

2. The safety interlock of claim 1 wherein said locking means comprises a first plate attached to said circuit breaker cover and a second plate hingeably attached to said first plate, said second plate including a slot and said first plate including an upstanding locking hasp said locking hasp being received within said slot when said second plate abuts to said first plate.

3. A circuit breaker safety interlock comprising;
a circuit breaker case and cover;
a pair of separable contacts within said case;
an operating mechanism within said case arranged for turning said contacts between OPEN and CLOSED conditions upon occurrence of an overcurrent condition within a protected circuit;
a trip-test button on said circuit breaker cover arranged for articulating said operating mechanism under quiescent current conditions through said protected circuit;

a movable paddle within said circuit breaker cover arranged for movement between a first position when said circuit breaker contacts are OPEN and a second position when said contacts are CLOSED;

locking means on said circuit breaker cover interacting with said paddle whereby said locking means accepts a lock when said paddle is in said first position and said locking means rejects said lock when said paddle is in said second position;

said locking means comprising a first plate attached to said circuit breaker cover and a second plate hingeably attached to said first plate, said second plate including a slot and said first plate including an upstanding locking hasp said locking hasp being received within said slot when said second plate abuts to said first plate; and said second plate including an interlock post arranged over said paddle, said paddle interfering with said interlock post when said paddle is in said second position to prevent said second plate from abutment with said first plate.

4. The safety interlock of claim 3 wherein said second plate includes a trip post arranged over said trip-test button, said trip post contacting said trip-test button when said second plate abuts said first plate.

5. The safety interlock of claim 1 including an auxiliary switch within said circuit breaker cover, said auxiliary switch interacting with said operating mechanism to thereby move said paddle between said first and second positions.

6. The safety interlock of claim 5 wherein said auxiliary switch includes an auxiliary switch cover arranged over said paddle, said auxiliary switch cover including an aperture.

7. The safety interlock of claim 6 including an accessory cover arranged over said auxiliary switch cover said accessory cover including an aperture, arranged over said auxiliary switch cover aperture.

8. The safety interlock of claim 5 wherein said auxiliary switch includes a lever driven by a crossbar assembly on said operating mechanism.

9. The safety interlock of claim 8 wherein said paddle includes a first aperture receiving one end of said lever and a second aperture receiving a pivot pin whereby said paddle rotates between said first and second positions about said pivot pin by operation of said lever.

10. The safety interlock of claim 7 wherein said auxiliary switch aperture and said accessory cover aperture are in alignment with said paddle when said paddle is in said second position to thereby obstruct passage of said interlock pin within said circuit breaker cover.

11. The safety interlock of claim 7 wherein said auxiliary switch aperture and said accessory cover aperture are out of alignment with said paddle when said paddle is in said first position to allow passage of said interlock pin within said circuit breaker cover.

* * * * *

UNITED STATES PATENT AND TRADEMARK OFFICE

CERTIFICATE OF CORRECTION

PATENT NO. : 5,113,043

DATED : 5-12-92

INVENTOR(S) : Robert A. Morris

It is certified that error appears in the above-identified patent and that said Letters Patent is hereby corrected as shown below:

Column 4:

Claim 1, line 38, after "cover" insert --arranged for articulating said operating mechanism under--.

Signed and Sealed this

Twenty-ninth Day of June, 1993

*Attest:*

*Attesting Officer*

Michael K. Kirk

MICHAEL K. KIRK

*Acting Commissioner of Patents and Trademarks*